US007192116B2

(12) United States Patent
Markham et al.

(10) Patent No.: US 7,192,116 B2
(45) Date of Patent: Mar. 20, 2007

(54) SYSTEMS AND METHODS FOR DISSIPATING HEAT FROM A FLUID EJECTOR CARRIAGE

(75) Inventors: Roger G. Markham, Webster, NY (US); Eric A. Merz, Palmyra, NY (US); Brian S. Hilton, Rochester, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 301 days.

(21) Appl. No.: 10/721,220

(22) Filed: Nov. 26, 2003

(65) Prior Publication Data

US 2005/0110828 A1 May 26, 2005

(51) Int. Cl.
*B41J 23/00* (2006.01)
*B41J 11/22* (2006.01)

(52) U.S. Cl. ..... 347/37; 400/354; 400/354.1

(58) Field of Classification Search ..... 347/37; 400/354

See application file for complete search history.

(56) References Cited

U.S. PATENT DOCUMENTS 3,855,448 A * 12/1974 Hanagata et al. ..... 347/171
4,566,345 A * 1/1986 Erikson et al. ..... 74/89.32
4,566,814 A * 1/1986 Papp et al. ..... 400/354.1
5,059,046 A * 10/1991 Tanuma et al. ..... 400/320
5,332,321 A * 7/1994 Beauchamp et al. ..... 400/354
5,880,754 A * 3/1999 Niikura et al. ..... 347/18
6,305,786 B1 * 10/2001 Plotkin et al. ..... 347/50
6,343,848 B2 * 2/2002 Berg et al. ..... 347/18
6,391,082 B1 * 5/2002 Holl ..... 75/230
6,575,646 B1 * 6/2003 Guillen et al. ..... 400/354
6,602,005 B2 * 8/2003 Curreno ..... 400/354
6,908,170 B2 * 6/2005 Merz ..... 347/18
2002/0001020 A1 * 1/2002 Mrvos et al. ..... 347/65

(Continued)

FOREIGN PATENT DOCUMENTS

JP 04113856 A * 4/1992
JP 06024097 A * 2/1994

OTHER PUBLICATIONS

Yaws, C.L. (1999). Chemical Properties Handbook . McGraw-Hill. Online version available at:http://www.knovel.com/knovel2/Toc.jsp?BookID=49&VerticalID=0; Thermal Conductivity of Liquid and Solid Inorganic Compounds Table.*

(Continued)

*Primary Examiner*—Manish S. Shah
*Assistant Examiner*—Rene Garcia, Jr.
(74) *Attorney, Agent, or Firm*—Oliff & Berridge, PLC

(57) ABSTRACT

A system, method and structures for dissipating heat away from a thermal fluid ejector modules through a thermally-conductive carriage molded from a polymer to the ambient air surrounding the structure upon which the thermally-conductive fluid ejector carriage translates. The heat is transferred via conduction and convection from the thermally-conductive fluid ejector carriage across a thin volume of air trapped between a thermally-conductive carriage rod guide, enclosed on each end by thermally-conductive carriage rod guide bearings, and the thermal contact of the thermally-conductive carriage rod guide bearings with the surface of at least one thermally-conductive carriage guide rod which the thermally-conductive fluid ejector carriage translates.

42 Claims, 2 Drawing Sheets

U.S. PATENT DOCUMENTS

2002/0067941 A1* 6/2002 Johnson et al. ..... 400/352
2003/0052933 A1* 3/2003 Shoji ..... 347/16
2003/0197767 A1* 10/2003 Dudenhoefer et al. ..... 347/93
2005/0024457 A1* 2/2005 Hilton et al. ..... 347/87
2005/0109766 A1* 5/2005 Miller et al. ..... 219/535
2005/0110820 A1* 5/2005 Merz et al. ..... 347/18
2006/0040112 A1* 2/2006 Dean et al. ..... 428/447

OTHER PUBLICATIONS

Cool Polymers, Inc. Website (www. coolpolymers.com); "Cool Polymers Thermally & Electrically Conductive Plastics".

* cited by examiner

FIG. 2
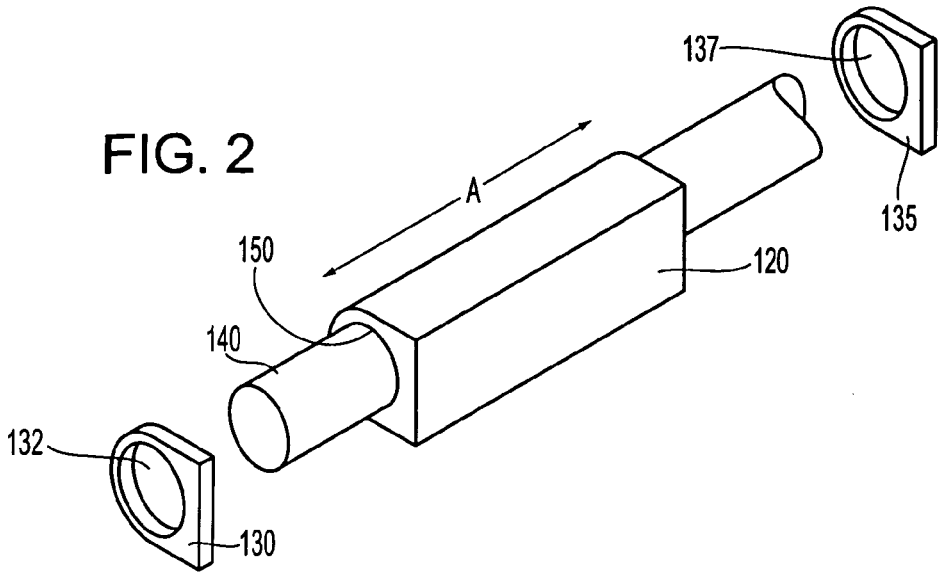
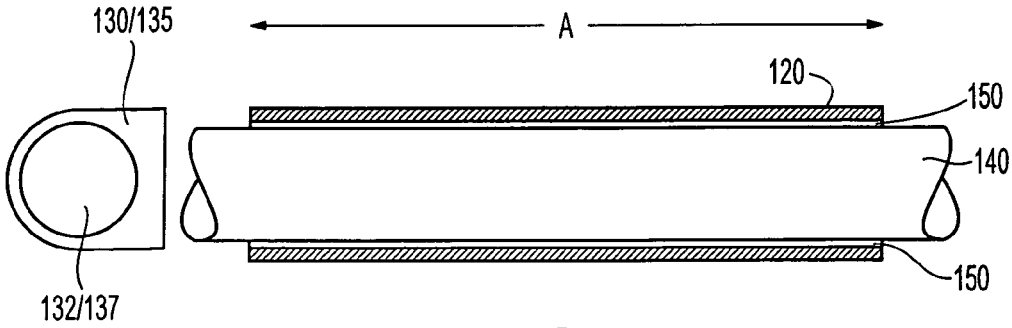
FIG. 3
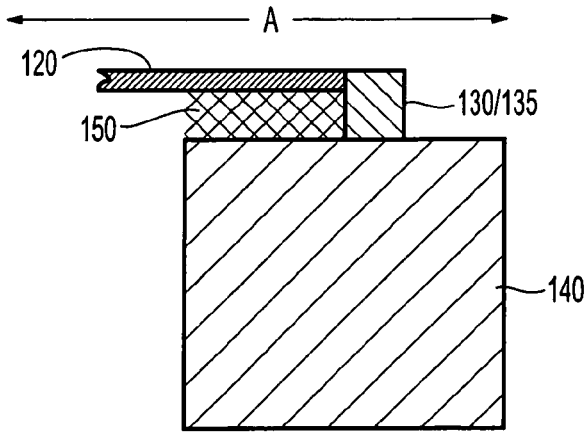
FIG. 4

SYSTEMS AND METHODS FOR DISSIPATING HEAT FROM A FLUID EJECTOR CARRIAGE

BACKGROUND OF THE INVENTION

1. Field of Invention

This invention is directed to systems, methods and structures for dissipating heat in fluid ejector heads.

2. Description of Related Art

A variety of systems, methods and structures are conventionally used to dissipate heat in a thermal fluid ejector head. The thermal fluid ejector heads of fluid ejection devices, such as, for example, ink jet printers, generate significant amounts of residual heat as the fluid is ejected by heating the fluid to the point of vaporization. This residual heat will change the performance, and ultimately the ejection quality, if the excess heat remains within the fluid ejector head. Changes in ejector performance are normally manifested by a change in the drop size, firing sequence, or other related ejection metrics. Such ejection metrics desirably remain within a controllable range for acceptable ejection quality. During lengthy operation or heavy coverage ejection, the temperature of the thermal fluid ejector head can exceed an allowable temperature limit. Once the temperature limit is exceeded, a slow down or cool down period is normally used to maintain the ejection quality.

Many fluid ejection devices, such as, for example, printers, copiers and the like, improve throughput by improving thermal performance. One technique to improve fluid ejector head performance is to divert excess heat into the fluid being ejected. Once the fluid being ejected has exceeded a predetermined temperature, the hot fluid is ejected from the fluid ejector head. During lengthy operation or heavy coverage ejection, this technique is also susceptible to temperatures in the fluid ejector head exceeding an allowable temperature limit.

Another technique is to use a heat sink to store heat, or conduct heat away, from the fluid ejector head. Typically, heat sinks are made from copper, aluminum or other materials having high thermal conductivity to remove heat from the thermal fluid ejector head. U.S. patent application Ser. No. 10/600,507, which is incorporated herein by reference in its entirety, discloses various exemplary embodiments of such heat sinks molded from a polymer mixed with at least one thermally-conductive filler material.

Heat sinks, however, add additional weight, size, cost and/or energy usage to the fluid ejector head. Each of these becomes disadvantageous when heat sinks are applied to fluid ejector heads that are translated past a receiving medium. Additionally, many fluids typically employed in fluid ejector heads, such as inks, use solvents and/or salts which are likely to corrode aluminum, copper and other like heat sink materials.

Other systems, methods and structures usable to conduct heat away from thermal fluid ejector heads include manufacturing and/or molding various print cartridge and fluid ejector carriage elements and components from thermally-conductive materials, to include a polymer or a polymer material mixed with at least one thermally-conductive filler material. U.S. patent application Ser. No. 10/721,221 and U.S. patent application Ser. No. 10/629,606, each incorporated herein by reference in its entirety, disclose various embodiments for thermally-conductive fluid ejector carriages and fluid ejector print cartridge components molded from polymers.

SUMMARY OF THE INVENTION

This invention provides systems, methods and structures that dissipate heat in a thermal fluid ejector head.

This invention separately provides systems, methods and structures that transfer heat from a fluid ejector head into a fluid ejector carriage device used to support the fluid ejector head.

This invention separately provides systems, methods and structures that obtain better thermal conductivity between a thermally-conductive fluid ejector carriage device, including such devices molded from a thermally-conductive polymer material, and at least one structure upon which a thermally-conductive fluid ejector carriage device translates. In various exemplary embodiments, such at least one structure includes, but is not limited to, a carriage guide rod and/or carriage guide rail.

In various exemplary embodiments of the systems, methods and structures according to this invention, thermally-conductive polymer components are molded to increase the surface area available to conduct heat away from a fluid ejector module. Using highly thermally-conductive polymers in molding and manufacturing various fluid ejector print cartridge and fluid ejector carriage elements yields certain advantages over the manufacture of these elements from traditionally highly thermally-conductive materials, such as aluminum and copper. Individual components molded from highly thermally-conductive polymers are typically smaller in size, and lighter in weight, resulting in lower energy usage in operation while still achieving high levels of heat dissipation. Additionally, thermally-conductive polymer components are less susceptible than are aluminum, copper and other traditional highly thermally-conductive materials to the corrosive effects of the solvents and/or salts that are often contained in the fluids, such as inks, that are ejected by thermal fluid ejector heads.

In various exemplary embodiments of the systems, methods and structures according to this invention, individual structures and/or devices are manufactured or molded to facilitate sufficient contact between adjoining elements to provide a thermally-conductive flow path adequate to dissipate heat during increasingly lengthy operation, or more intense periods of heavy coverage ejection, to maintain the temperature in the fluid ejector module within allowable limits, thus assuring highest ejection quality.

To achieve even greater output rates from fluid ejector head printing systems, while maintaining desired print quality, greater heat dissipation methodologies are desirable. The systems, methods and structures by which heat is dissipated from the fluid ejector module through various thermally-conductive elements, including components of fluid ejector printer cartridges and fluid ejector carriage devices, are extended to various other components which include, but which are not limited to, structures upon which the fluid ejector carriage device translates, such as, for example fluid ejector carriage guide rods and/or carriage guide rails, and supporting structures.

In various exemplary embodiments of the systems, methods and structures according to this invention, a thermally-conductive fluid ejector carriage device molded from a polymer material is used to transfer heat generated by at least one fluid ejector module to the relatively larger surface area of at least one such structure upon which the fluid ejector carriage device translates.

In various exemplary embodiments, the systems, methods and structures according to this invention provide at least one thermally-conductive interface between the fluid ejector carriage device and the structure upon which the fluid ejector carriage device translates, such as, for example, a thermally-conductive tube-like carriage rod guide, usable to dissipate heat from the thermally-conductive fluid ejector carriage device. In various exemplary embodiments, the systems, methods and structures according to this invention provide at least one thermally-conductive structure upon which the fluid ejector carriage device translates, such as, for example, a thermally-conductive carriage guide rod, with properties that allow the thermally-conductive structure to readily dissipate heat to surrounding ambient air.

In various exemplary embodiments of the systems, methods and structures according to this invention, heat is transferred along a thermally-conductive path from the fluid ejector module through the thermally-conductive fluid ejector carriage device to at least one thermally-conductive interface, or tube-like carriage rod guide, and further to at least one thermally-conductive structure, or carriage guide rod, to facilitate heat dissipation through conduction and/or convection.

In various exemplary embodiments of the systems, methods and structures according to this invention, the relatively large surface area of the at least one thermally-conductive structure provides increased area through which heat can dissipate to surrounding ambient air than is available from any individual thermally-conductive component. Additional heat transfer, and resultant heat dissipation, is accomplished through a "fanning" motion of the thermally-conductive fluid ejector carriage device and the at least one thermally-conductive interface as the at least one thermally-conductive interface translates along the at least one thermally-conductive structure.

In various exemplary embodiments of the systems and methods according to this invention, heat transfer between at least one thermally-conductive tube-like carriage rod guide and at least one thermally-conductive carriage guide rod is facilitated by contact between at least one thermally-conductive carriage rod guide bearing and the at least one thermally-conductive carriage guide rod. This contact facilitates conduction directly to at least one thermally-conductive carriage guide rod. Additionally, contact between the at least one thermally-conductive carriage rod guide bearing and the at least one thermally-conductive carriage guide rod facilitates trapping a thin volume of air for dissipating heat through convection.

In various exemplary embodiments of the systems, methods and structures according to this invention, contact between the at least one thermally-conductive carriage rod guide bearing and the at least one thermally-conductive carriage guide rod is augmented using compliant, thermally-conductive pads, and/or phase change or other thermally-conductive heat sink compounds, and/or other like devices or materials usable to enhance the thermal path between the at least one thermally-conductive carriage rod guide bearing and the at least one thermally-conductive carriage guide rod while not impeding fluid ejector carriage motion.

These and other features and advantages of the disclosed embodiments are described in, or are apparent from, the following detailed description of various exemplary embodiments of the systems, methods and structures according to this invention.

BRIEF DESCRIPTION OF THE DRAWINGS

Various exemplary embodiments of the invention will be described in detail, with reference to the following figures, wherein:

FIG. 2 illustrates an exemplary thermally-conductive carriage rod guide, the thermally-conductive carriage guide rod and thermally-conductive carriage rod guide bearings usable with various exemplary embodiments of the systems, methods and structures according to this invention;

FIG. 3 is a cut-away and exploded view illustrating the thermally-conductive carriage rod guide, the thermally-conductive carriage guide rod and the thermally-conductive carriage rod guide bearings of FIG. 2;

FIG. 4 is a cross-sectional view of the thermally-conductive carriage rod guide, the thermally-conductive carriage guide rod and the thermally-conductive carriage rod guide bearing; and

DETAILED DESCRIPTION OF EXEMPLARY EMBODIMENTS

Figure 1:
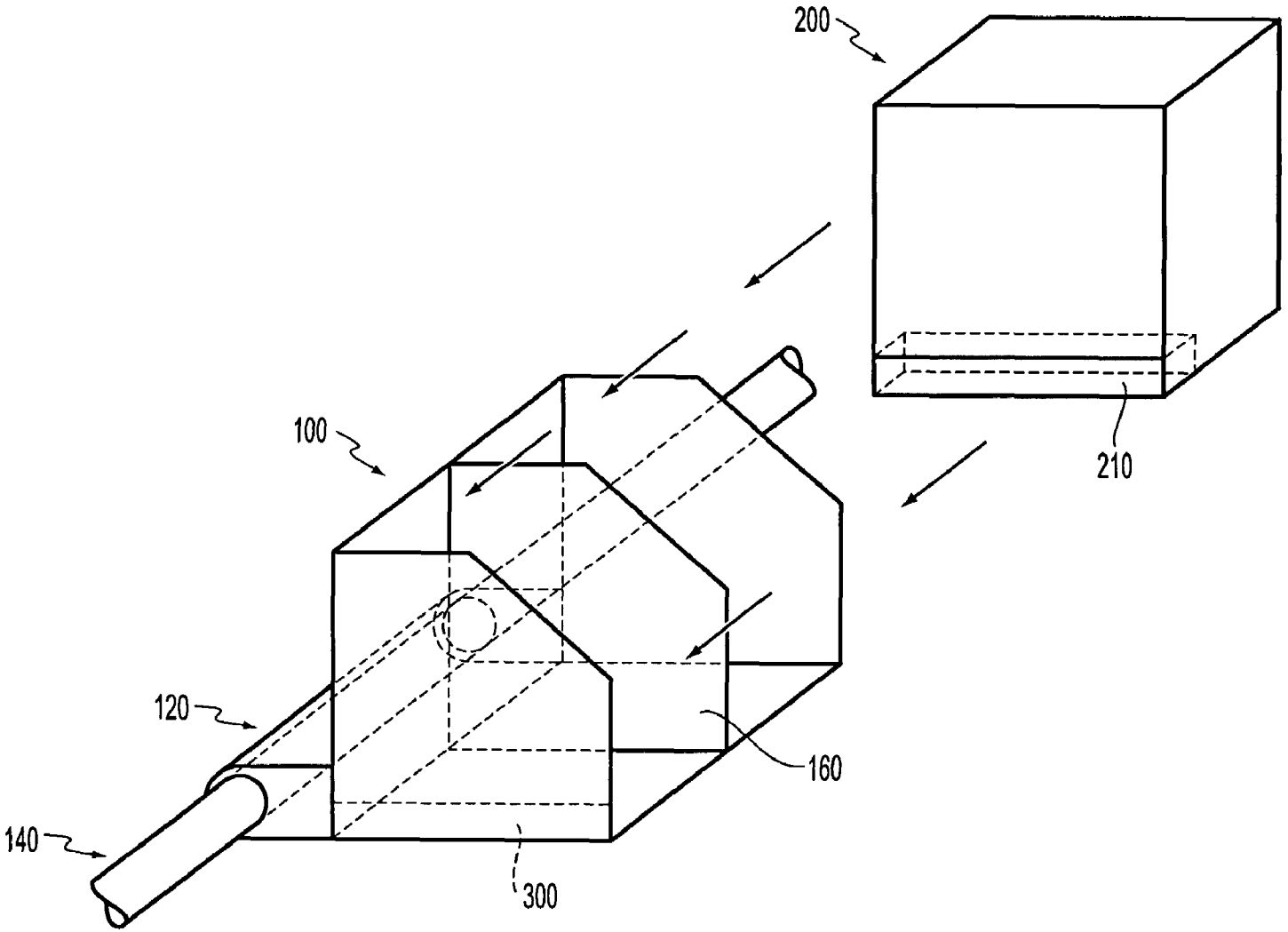
FIG. 1 illustrates a first exemplary embodiment of a thermally-conductive fluid ejector carriage and a thermally-conductive structure upon which the thermally-conductive carriage translates usable with various exemplary embodiments of the systems, methods and structures according to this invention.

The following description of various exemplary embodiments of the fluid ejection systems according to this invention may refer to and/or illustrate one specific type of fluid ejection system, a thermal ink jet printer, for the sake of clarity and familiarity. However, it should be appreciated that the principles of this invention, as outlined and/or discussed below, can be equally applied to any known or later-developed fluid ejection system, wherein a moving fluid ejector carriage translates along at least structure, beyond the ink jet printer specifically discussed herein.

Various exemplary embodiments of the systems, methods and structures according to this invention enable heat dissipation from fluid ejector heads, such as those found in, for example, thermal ink jet printers, copiers, facsimile machines and/or other devices containing moving carriages that translate in varying, most often reciprocating, directions along at least one structure and that thermally eject fluid onto a receiving medium. In various exemplary embodiments, heat is dissipated through various components, and specifically at least one structure along which a fluid ejector carriage device translates and/or at least one structure which provides a thermally-conductive interface and/or connection between the fluid ejector carriage device and such structure. For clarity and simplicity in description, reference is made to at least one carriage rod guide and at least one carriage guide rod fashioned from thermally-conductive elements as the exemplary interface and exemplary structure upon which the fluid ejector carriage device translates. It should be appreciated, however, that these represent only exemplary embodiments to which the systems, methods and structures according to this invention are not limited.

In various exemplary embodiments of the systems, methods and structures according to this invention, a polymer, or a polymer material mixed with at least one thermally-conductive filler material, is used to form various thermally-conductive components for heat transfer from a fluid ejector module along a heat dissipation path which includes thermally-conductive fluid ejector print cartridge elements, a thermally-conductive fluid ejector carriage device, at least one thermally-conductive like carriage rod guide, and at least one thermally-conductive carriage guide rod to surrounding ambient air. The incorporated '507 and '606 applications disclose various embodiments for various intermediate thermally-conductive components that can be combined to form a heat flow path from the fluid ejector module to at least one thermally-conductive carriage guide rod according to this invention.

In various exemplary embodiments, the systems, methods and structures according to this invention provide at least one thermally-conductive tube-like carriage rod guide and at least one thermally-conductive carriage guide rod manufactured and/or molded from thermally-conductive materials, which include, but which are not limited to, aluminum, copper, and/or a polymer, or polymer material having at least one thermally-conductive filler material, with properties that allow the carriage guide rod to more readily dissipate heat to the surrounding ambient air.

In various exemplary embodiments of the systems, methods and structures according to this invention, heat is transferred by conduction through a thermally-conductive path from the fluid ejector head through the thermally-conductive fluid ejector carriage device and then, for example, through at least one thermally-conductive tube-like carriage rod guide and conformal carriage rod guide bearings mounted on, or molded into, one or both ends of the at least one thermally-conductive tube-like carriage rod guide, to at least one thermally-conductive carriage guide rod, where the bearings are in sufficient contact with the at least one thermally-conductive carriage guide rod to facilitate surface-to-surface heat conduction but not so much in contact that motion of the fluid ejector carriage device along the at least one thermally-conductive carriage guide rod is impeded.

In various exemplary embodiments, the systems, methods and structures according to this invention transfer heat to be dissipated along the at least one thermally-conductive carriage guide rod using convection through a thin volume of air trapped, for example, between an internal surface of at least one thermally-conductive tube-like carriage rod guide bounded on at least one end by at least one thermally-conductive carriage rod guide bearing, and the surface of the at least one thermally-conductive carriage guide rod. In various exemplary embodiments of the systems, methods and structures according to this invention, this thin volume of trapped air is sheared across the surface of a thermally-conductive carriage guide rod during motion of the fluid ejector carriage device and the thermally-conductive tube-like carriage rod guide along the thermally-conductive carriage guide rod. This shearing enhances heat transfer across the interface between the thermally-conductive tube-like carriage rod guide and the thermally-conductive carriage guide rod, resulting in increased heat transfer to surrounding ambient air based on the thermal contact between the thermally-conductive carriage guide rod and the ambient air.

Additional heat transfer, and resultant heat dissipation, is accomplished through a "fanning" motion of the thermally-conductive fluid ejector carriage and the at least one thermally-conductive tube-like carriage rod guide as the at least one thermally-conductive tube-like carriage rod guide translates along the at least one thermally-conductive carriage guide rod.

In various exemplary embodiments of the systems, methods and structures according to this invention, at least one carriage guide rod is manufactured and/or molded using any highly thermally-conductive materials, including, for example, but not limited to, aluminum, copper, or certain thermally-conductive polymers. The thermal conductivity of aluminum is, by example, about 100–150 W/m° C. The thermal conductivity of the highly thermally-conductive polymers is in the range of about 10–100 W/m° C. or greater.

Thermally-conductive components, such as fluid ejector print cartridges, fluid ejector carriages, carriage rod guides, carriage rod guide bearings and carriage guide rods are used to carry heat away from fluid ejector module containing the heater element of a thermal fluid ejector head, allowing the fluid ejector head to operate in an acceptable temperature range for extended periods of time. Dissipating heat away from the fluid ejector module allows the thermal fluid ejector head to operate at temperatures cool enough to enable consistent high quality fluid ejection.

In various exemplary embodiments according to this invention, highly thermally-conductive polymers are used for the carriage rod guide and carriage guide rod material. In various exemplary embodiments, such highly thermally-conductive polymers, include base polymers mixed with a variety of filler materials. For example, one such polymer material is COOL POLY™ made by Cool Polymers Inc. Specifically, COOL POLY E200™ polymer material is an injection-moldable, liquid crystalline polymer (LCP) based material having a thermal conductivity of about 60 W/m° C. Other companies such as Polyone, LDP Engineering Plastics, RPP Company, GE and Dupont, have developed highly thermally-conductive polymers that may also be used in forming carriage rod guides and carriage guide rods according to this invention.

Typical filler materials include graphite fibers and ceramic materials such as boron, nitride, and aluminum nitride fibers. In various exemplary embodiments, blends of highly thermally-conductive polymers that have high thermal conductivity use graphite fibers formed from petroleum pitch base material. Typical base materials for the polymers include LCP, polyphenylene sulfide and polysulfone.

FIG. 1 illustrates a first exemplary embodiment of a thermally-conductive fluid ejector carriage 100 and a thermally-conductive structure upon which the thermally-conductive carriage translates 140 usable with various exemplary embodiments of the systems, methods and structures according to this invention. As shown in FIG. 1, the thermally-conductive fluid ejector carriage 100 is usable to conduct heat away from a thermal fluid ejector print cartridge 200 when the thermal fluid ejector print cartridge 200 is inserted, installed, or otherwise brought into contact with an appropriately sized receiving area 160 of the thermally-conductive fluid ejector carriage 100. The thermally-conductive fluid ejector carriage 100 transfers heat from the thermal fluid ejector head 210. In various exemplary embodiments, heat is transferred through at least one conformal thermally-conductive carriage rod guide 120 to the thermally-conductive carriage guide rod 140, and then into surrounding ambient air.

In various exemplary embodiments of the systems, methods and structures according to this invention, a thermal fluid ejector print cartridge 200 contains at least one thermal fluid ejector head 210. While depicted in FIG. 1 as being mounted integrally into the face of the exemplary print cartridge 200, it should be appreciated that the at least one thermal fluid ejector head 210 may be mounted in, or attached externally to, any face of the thermal fluid ejector print cartridge 200, or may be mounted in the thermally-conductive fluid ejector carriage 100 as a stand-alone assembly. Placement of the at least one thermal fluid ejector head 210 on the thermal fluid ejector print cartridge 200 desirably facilitates at least indirect contact between the thermal fluid ejector head 210 and a suitable contact area 300 on the thermally-conductive fluid ejector carriage 100.

In various exemplary embodiments of the systems, methods and structures according to this invention, at least one thermally-conductive carriage rod guide 120 is molded integrally with, or separately attached to, the thermally-conductive fluid ejector carriage 100 such that a sufficient heat flow path is established to transfer heat from the thermal fluid ejector head 210 through the thermally-conductive fluid ejector carriage 100 and into the thermally-conductive carriage rod guide 120. In various exemplary embodiments, heat is further transferred from the thermally-conductive carriage rod guide 120 into the thermally-conductive carriage guide rod 140, as will be explained in greater detail below.

FIGS. 2 illustrates an exemplary thermally-conductive carriage rod guide 120, thermally-conductive carriage guide rod 140 and thermally-conductive carriage rod guide bearings 130 and 135 usable with various exemplary embodiments of the systems, methods and structures according to this invention. FIG. 3 is a cut-away and exploded view illustrating the thermally-conductive carriage rod guide 120, the thermally-conductive carriage guide rod 140 and the thermally-conductive carriage rod guide bearings 130 and 135 of FIG. 2. As shown in FIGS. 2 and 3, in various exemplary embodiments according to this invention, a thermally-conductive carriage rod guide 120 is a hollow tube-like transverse member with a through-opening generally conformal in shape to, but slightly larger in cross-sectional area than, the thermally-conductive carriage guide rod 140 upon which the thermally-conductive carriage rod guide 120 is designed to translate in a direction A. The resulting difference in cross-sectional area leaves a space or gap 150 between the inner surface of the thermally-conductive carriage rod guide 120 and the surface of the thermally-conductive carriage guide rod 140, where the space or gap 150 accommodates a thin layer of air.

The thermally-conductive carriage guide rod 140 is depicted in FIGS. 2 and 3 having an essentially circular cross-section such that an opening in the thermally-conductive carriage rod guide 120 has a slightly larger circular cross-section. However, it should be appreciated that in various exemplary embodiments, a thermally-conductive carriage guide rod 140 and conforming thermally-conductive carriage rod guide 120 may have cross sections of any desired simple or complex shape, or any cross-sectional pattern that provides sufficient surface area of the thermally-conductive carriage guide rod 140 to obtain sufficient heat transfer capacity between the thermally-conductive carriage guide rod 140 and surrounding ambient air.

It should be further appreciated that the structure upon which the fluid ejector carriage translates according to this invention is not, in any way, limited to an exemplary thermally-conductive carriage guide rod 140 and an exemplary thermally-conductive carriage rod guide 120 as depicted in FIG. 2 and FIG. 3. These depictions are illustrative and in no way limiting.

In various exemplary embodiments of the systems, methods and structures according to this invention, the ends of the thermally-conductive carriage rod guide 120 are enclosed with thermally-conductive carriage rod guide bearings 130 and 135 that are separate structures mounted onto the ends of, or integral structures that are molded with, the thermally-conductive carriage rod guide 120.

In various exemplary embodiments, the thermally-conductive carriage rod guide bearings 130 and 135 are designed and manufactured such that openings 132 and 137 in the thermally-conductive carriage rod guide bearings 130 and 135, respectively, generally have similar cross-sectional shapes to the cross-sectional shape of the thermally-conductive carriage guide rod 140. In various exemplary embodiments, the thermally-conductive carriage rod guide bearings 130 and 135 are held in tight relationship to the thermally-conductive carriage guide rod 140. Such exemplary design provides a medium for conducting heat based on contact between the thermally-conductive carriage rod guide bearings 130 and 135 and the thermally-conductive carriage guide rod 140.

In various exemplary embodiments of the systems, methods and structures according to this invention, the space or gap 150 between an internal surface of the thermally-conductive carriage rod guide 120 and the surface of the thermally-conductive carriage guide rod 140 contains a thin layer of air that is enclosed by the thermally-conductive carriage rod guide bearings 130 and 135 to form a thin volume of trapped air that dissipates heat through convection. The trapped air is heated by transferring heat from an internal surface of the thermally-conductive carriage rod guide 120 as the thermally-conductive carriage rod guide 120 conducts heat from the thermally-conductive fluid ejector carriage 100. The thin volume of trapped air is aggressively sheared across the surface of the thermally-conductive carriage guide rod 140 as the thermally-conductive fluid ejector carriage 100, and specifically, the thermally-conductive carriage rod guide 120, translates along the thermally-conductive carriage guide rod 140 in a direction A.

FIG. 4 is a cross-sectional view of the thermally-conductive carriage rod guide 120, the thermally-conductive carriage guide rod 140 and the thermally-conductive carriage rod guide bearing 130 or 135. As shown in FIG. 4, a space or gap 150 between the internal surface of the thermally-conductive carriage rod guide 120, the surface of the thermally-conductive carriage guide rod 140, and the thermally-conductive carriage guide rod bearings 130 or 135 traps a thin volume of air.

In various exemplary embodiments according to this invention, this trapped volume of air is mixed in a complex air flow pattern as the assembly of the thermally-conductive carriage rod guide 120 and the thermally-conductive carriage rod guide bearings 130 and 135 translates along the thermally-conductive carriage guide rod 140 in a direction A. This complex air flow pattern results in increased conduction and/or convection as heat is transferred from the thermally-conductive carriage rod guide 120 and the thermally-conductive carriage rod guide bearings 130 and 135 across the thin space or gap 150, into at least one thermally-conductive carriage guide rod 140. Heat is then dissipated along the at least one thermally-conductive carriage guide rod 140 and to the surrounding ambient air through convection.

In various exemplary embodiments of the systems, methods and structures according to this invention, the thermally-conductive carriage rod guide bearings 130 and 135 are molded from any thermally-conductive material, which can include, for example, aluminum, copper and/or any thermally-conductive polymer material. In various exemplary embodiments of the systems, methods and structures according to this invention, compliant, thermally-conductive pad materials, phase change or other thermally-conductive heat sink compounds, and/or other like devices or materials usable to conduct heat, are added to enhance the thermal path, and/or to seal the interface, between the thermally-conductive carriage rod guide bearings 130 and 135 and the thermally-conductive carriage guide rod 140. It should be appreciated that any device and/or material usable to enhance the thermally conductive path between the thermally-conductive carriage rod guide bearings 130 and 135 and the thermally-conductive carriage guide rod 140 may be added as long as the motion of the thermally-conductive fluid ejector carriage device 100 along the thermally-conductive carriage guide rod 140 is not impeded.

It should be appreciated that other separate structures and/or devices can be provided between the thermally-conductive fluid ejector carriage 100 and the thermally-conductive carriage guide rod 140 to provide, augment, or enhance the heat flow path between the thermally-conductive fluid ejector carriage 100, and the thermally-conductive carriage guide rod 140 such that sufficient heat transfer between the thermally-conductive fluid ejector carriage 100, and the thermally-conductive carriage guide rod 140 is obtained.

While this invention has been described in conjunction with the exemplary embodiments outlined above, various alternatives, modifications, variations, improvements, and/or substantial equivalents, whether known or that are, or may be, presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later-developed alternatives, modifications, variations, improvements, and/or substantial equivalents.

What is claimed is:

1. A fluid ejector, comprising:

a thermally-conductive fluid ejector carriage;

a structure upon which the thermally-conductive carriage translates; and at least one thermally-conductive interface structure between the thermally-conductive fluid ejector carriage and the structure upon which the thermally-conductive carriage translates that provides a heat flow path from the thermally-conductive fluid ejector carriage into the at least one thermally-conductive interface structure, wherein the at least one thermally-conductive interface structure comprises at least one thermally-conductive material including at least one polymer material and at least one thermally-conductive filler material.

2. The fluid ejector of claim 1, wherein the at least one thermally-conductive interface structure is a carriage rod guide with substantially a hollow tube-like structure.

3. The fluid ejector of claim 1, wherein at least one polymer is at least one of liquid crystal polymer, polyphenylene sulfide and polysulfone.

4. The fluid ejector of claim 1, wherein at least one polymer is chemically resistant to ink.

5. The fluid ejector of claim 1, wherein at least one of the at least one thermally-conductive filler material has a thermal conductivity greater than about 10 W/m° C.

6. The fluid ejector of claim 1, wherein at least one of the at least one thermally-conductive filler material has a thermal conductivity less than about 100 W/m° C.

7. The fluid ejector of claim 6, wherein at least one of the at least one thermally-conductive filler material has a thermal conductivity of greater than 10 W/m° C.

8. The fluid ejector of claim 1, wherein at least one of the at least one thermally-conductive filler material includes a graphite material.

9. The fluid ejector of claim 8, wherein the graphite material is formed using a petroleum pitch base material.

10. The fluid ejector of claim 1, wherein at least one of the at least one thermally-conductive filler material is a ceramic material.

11. The fluid ejector of claim 10, wherein the ceramic material is at least one of boron nitride and aluminum nitride.

12. The fluid ejector of claim 1, wherein the structure upon which the thermally-conductive carriage translates is at least one thermally-conductive carriage guide rod, where the at least one thermally-conductive interface structure translates along the at least one thermally-conductive carriage guide rod.

13. The fluid ejector of claim 12, wherein the at least one thermally-conductive carriage guide rod comprises at least one thermally-conductive material.

14. The fluid ejector of claim 13, wherein at least one thermally-conductive material includes at least one polymer.

15. The fluid ejector of claim 14, wherein at least one polymer is at least one of liquid crystal polymer, polyphenylene sulfide and polysulfone.

16. The fluid ejector of claim 14, wherein at least one polymer is chemically resistant to ink.

17. The fluid ejector of claim 13, wherein at least one thermally-conductive material includes a polymer material and at least one thermally-conductive filler material.

18. The fluid ejector of claim 17, wherein at least one of the at least one thermally-conductive filler material has a thermal conductivity greater than about 10 W/m° C.

19. The fluid ejector of claim 17, wherein at least one of the at least one thermally-conductive filler material has a thermal conductivity less than about 100 W/m° C.

20. The fluid ejector of claim 19, wherein at least one of the at least one thermally-conductive filler material has a thermal conductivity of greater than 10 W/m° C.

21. The fluid ejector of claim 17, wherein at least one of the at least one thermally-conductive filler material includes a graphite material.

22. The fluid ejector of claim 21, wherein the graphite material is formed using a petroleum pitch base material.

23. The fluid ejector of claim 17, wherein at least one of the at least one thermally-conductive filler material is a ceramic material.

24. The fluid ejector of claim 23, wherein the ceramic material is at least one of boron nitride and aluminum nitride.

25. The fluid ejector of claim 12, wherein the at least one thermally-conductive interface structure that translates along the at least one thermally-conductive carriage guide rod is a hollow tube-like rod guide structure that has a generally corresponding cross-sectional shape and a slightly larger cross-sectional area than that of the at least one thermally-conductive carriage guide rod, such that a thin film of air is present between the surface of the at least one thermally-conductive carriage guide rod and an internal surface of the at least one thermally-conductive tube-like carriage rod guide.

26. The fluid ejector of claim 25, further comprising at least one thermally-conductive rod guide bearing that encloses at least one open end of the at least one thermally-conductive carriage rod guide.

27. The fluid ejector of claim 26, wherein the at least one thermally-conductive rod guide bearing has an opening having a generally corresponding cross-sectional shape and a generally corresponding cross-sectional area as that of the at least one thermally-conductive carriage guide rod, such that the at least one thermally-conductive carriage rod guide bearing and the at least one thermally-conductive carriage guide rod provide a heat flow path to conduct heat from the thermally-conductive fluid ejector carriage and the at least one thermally-conductive carriage rod guide into the at least one thermally-conductive carriage guide rod.

28. The fluid ejector of claim 27, wherein motion of the fluid ejector carriage and the at least one thermally-conductive carriage rod guide, as the at least one thermally-conductive carriage rod guide translates along the at least one thermally-conductive carriage guide rod, is not impeded by contact between the at least one thermally-conductive carriage rod guide bearing and the at least one thermally-conductive carriage guide rod.

29. The fluid ejector of claim 27, further comprising at least one compliant, thermally-conductive pad that is usable to augment contact between the at least one thermally-conductive carriage rod guide bearing and the at least one thermally-conductive carriage guide rod.

30. The fluid ejector of claim 27, further comprising at least one phase change or other thermally-conductive heat sink compound that is usable to augment contact between the at least one thermally-conductive carriage rod guide bearing and the at least one thermally-conductive carriage guide rod.

31. The fluid ejector of claim 27, further comprising at least one mechanical device or structure usable to conduct heat that is usable to augment contact between the at least one thermally-conductive carriage rod guide bearing and the at least one thermally-conductive carriage guide rod.

32. The fluid ejector of claim 26, wherein the at least one thermally-conductive carriage rod guide bearing traps a thin volume of air bounded by an internal surface of the at least one thermally-conductive carriage rod guide, the surface of the at least one thermally-conductive carriage guide rod and the at least one thermally-conductive carriage guide rod bearing.

33. The fluid ejector of claim 32, wherein heat is dissipated through convection through the thin volume of air as the thin volume of air is sheared across the surface of the at least one thermally-conductive carriage guide rod as the fluid ejector carriage and the at least one thermally-conductive carriage rod guide translate along the at least one thermally-conductive carriage guide rod.

34. A method for dissipating heat from a fluid ejector module, comprising:

operating at least one fluid ejector module to generate heat in the fluid ejector module;

transferring the heat from the fluid ejector module to a thermally-conductive fluid ejector carriage device with which the fluid ejector module is in thermal contact;

transferring heat from the thermally-conductive fluid ejector carriage device to at least one thermally-conductive interface structure between the fluid ejector carriage device and a structure upon which the fluid ejector carriage device translates, the at least one thermally-conductive interface structure comprising at least one thermally-conductive material including at least one polymer material and at least one thermally-conductive material; and transferring heat from the at least one thermally-conductive interface structure to ambient air based on the thermal contact between the surface of the at least one thermally-conductive interface structure and the surrounding ambient air.

35. The method of claim 34, further comprising:

transferring heat from the at least one thermally-conductive interface structure to at least one thermally-conductive structure upon which the fluid ejector carriage device translates; and transferring heat from the at least one thermally-conductive interface structure to ambient air based on the thermal contact between the surface of the at least one thermally-conductive structure upon which the fluid ejector carriage device translates and the surrounding ambient air.

36. The method of claim 35, wherein transferring heat through the surface-to-surface contact between the at least one thermally-conductive carriage rod guide bearing to the at least one thermally-conductive carriage guide rod comprises transferring heat through a compliant, thermally-conductive pad located between the at least one thermally-conductive carriage rod guide bearing to the at least one thermally-conductive carriage guide rod.

37. The method of claim 35, wherein transferring heat through the surface-to-surface contact between the at least one thermally-conductive carriage rod guide bearing to the at least one thermally-conductive carriage guide rod comprises transferring heat through a phase change or other thermally-conductive heat sink compound located between the at least one thermally-conductive carriage rod guide bearing to the at least one thermally-conductive carriage guide rod.

38. The method of claim 34, wherein transferring heat from the at least one thermally-conductive interface structure to the at least one thermally-conductive structure upon which the fluid ejector carriage device translates comprises:

transferring heat from at least one thermally-conductive carriage rod guide to at least one thermally-conductive carriage rod guide bearing; and transferring heat from the at least one thermally-conductive carriage rod guide bearing to the at least one thermally-conductive carriage guide rod through surface-to-surface contact between the at least one thermally-conductive carriage rod guide bearing to the at least one thermally-conductive carriage guide rod.

39. The method of claim 34, wherein transferring heat from the at least one thermally-conductive interface structure to the at least one thermally-conductive structure upon which the fluid ejector carriage translates further comprises:

transferring heat from the internal surface of at least one thermally-conductive carriage rod guide to a thin volume of air trapped between at least an internal surface of at least one thermally-conductive carriage rod guide, and a surface of the at least one thermally-conductive carriage guide rod; and transferring heat from the thin volume of trapped air to the at least one thermally-conductive carriage guide rod.

40. The method of claim 39, further comprising inducing a complex air flow pattern in the thin volume of air trapped between at least an internal surface of the at least one thermally-conductive carriage rod guide and a surface of the at least one thermally-conductive carriage guide rod as the at least one the thermally-conductive carriage rod guide translates along the at least one thermally-conductive carriage guide rod.

41. The method of claim 39, further comprising shearing the thin volume of air trapped between at least an internal surface of the at least one thermally-conductive carriage rod guide and a surface of the at least one thermally-conductive carriage guide rod across the surface of the at least one thermally-conductive carriage guide rod as the at least one thermally-conductive carriage rod guide translates along the at least one thermally-conductive carriage guide rod.

42. The method of claim 34, wherein transferring heat from the from the thermally-conductive fluid ejector carriage device and the at least one thermally-conductive interface structure to the surrounding ambient air comprises transferring heat from the from the thermally-conductive fluid ejector carriage device and the at least one thermally-conductive interface structure to the surrounding ambient air via a fanning motion of the thermally-conductive fluid ejector carriage device and the at least one thermally-conductive interface structure as the at least one thermally-conductive interface structure translates along at least one thermally-conductive structure upon which the thermally-conductive fluid ejector carriage device and thermally-conductive interface structure translate.

* * * * *